United States Patent [19]

Goldberg

[11] 4,360,134

[45] Nov. 23, 1982

[54] HEADDRESS DISPLAY DEVICE

[75] Inventor: Mel Goldberg, New Fairfield, Conn.

[73] Assignee: Topstone Industries, Inc., New York, N.Y.

[21] Appl. No.: 193,807

[22] Filed: Oct. 3, 1980

[51] Int. Cl.[3] ..... D06C 15/00

[52] U.S. Cl. ..... 223/66; 211/36; 248/174

[58] Field of Search ..... 223/66, 24, 64; 211/33; 248/165, 174, 177

[56] References Cited

U.S. PATENT DOCUMENTS

| | | | |
|---|---|---|---|
| 1,822,297 | 9/1931 | Kemery | 211/33 |
| 2,107,178 | 2/1938 | Fackler | 211/33 |
| 2,456,964 | 12/1948 | LeDure | 248/174 X |
| 2,480,731 | 8/1949 | Haughwout | 211/33 |
| 3,501,072 | 3/1970 | Kovener | 223/66 |
| 3,940,100 | 2/1976 | Haug | 248/165 |

FOREIGN PATENT DOCUMENTS

| | | | |
|---|---|---|---|
| 722068 | 3/1932 | France | 223/66 |

*Primary Examiner*—Louis Rimrodt

*Attorney, Agent, or Firm*—Mandeville and Schweitzer

[57] ABSTRACT

A collapsible or knock-down headdress display device is provided. The display comprises a base member and a head silhouette member which is connected to the base member to provide a three dimensional (3-D) headdress display. When the display is assembled a full or partial facial mask or hair wig can be realistically displayed. Additionally, head contour members are also provided which connect to the head silhouette member and provide a curved back support for the sides of the facial mask or wig displayed.

2 Claims, 6 Drawing Figures

FIG. 4
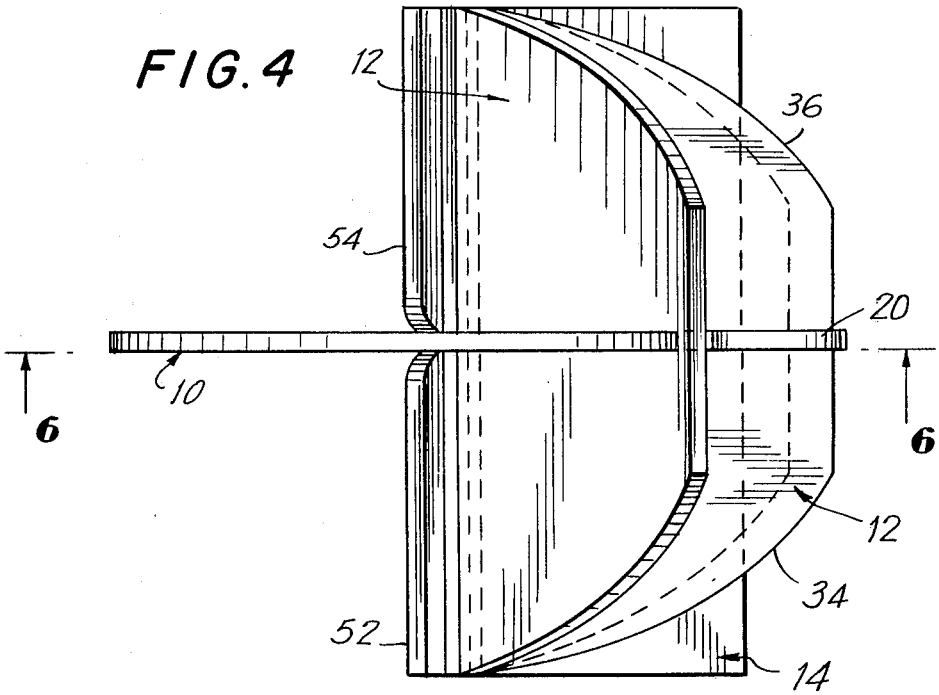
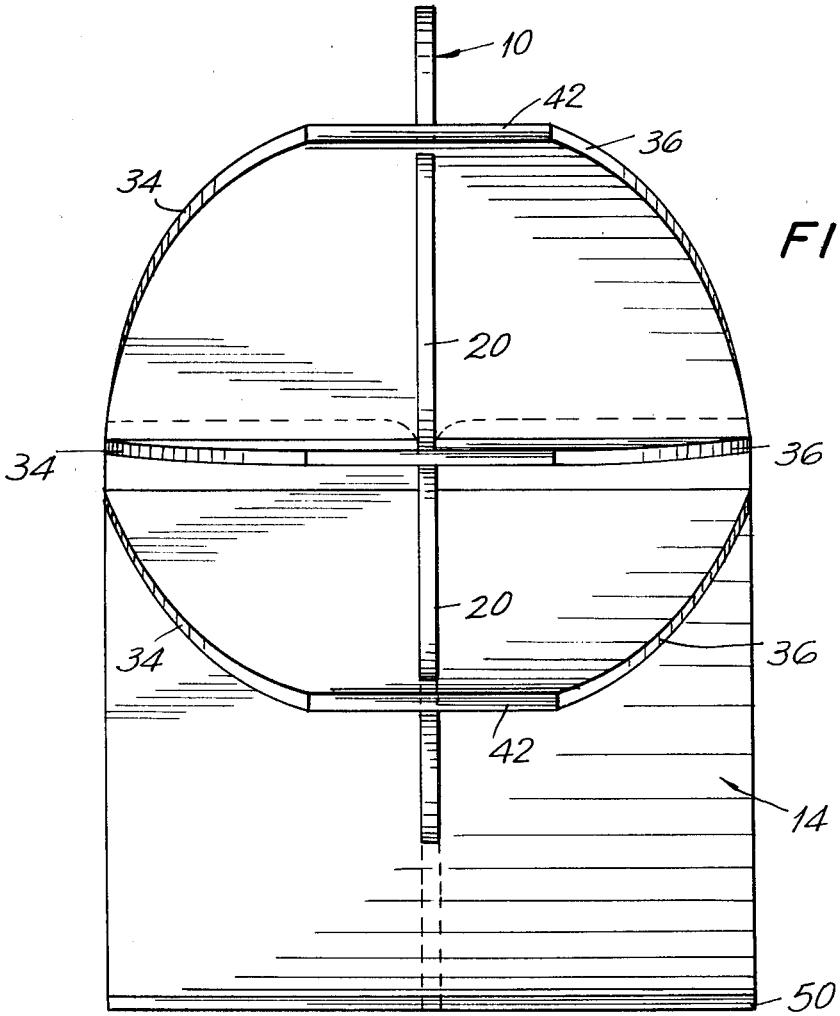
FIG. 5

HEADDRESS DISPLAY DEVICE

BACKGROUND OF THE INVENTION

This invention generally relates to a full or partial facial mask or wig display device which is capable of being shipped in a collapsed or knock-down condition and, when desired, can be easily assembled to provide a 3-D display device. Full or partial facial masks, complete over-the-head masks, wigs, hairpieces, etc. can all be realistically displayed on the subject invention and are intended to be included under the broad term "headdress", used throughout this disclosure. More specifically, the present invention relates to a knock-down headdress display, preferably constructed of interfitting cardboard members, which is inexpensive to manufacture, capable of being shipped in a flat condition, and, as and when desired, assembled into a 3-D stable form over which the headdress item to be displayed is placed.

DESCRIPTION OF THE PRIOR ART

Headdress display devices have, in the past, been used by wig and mask manufacturers. The prior art headdress display devices have been either 3-D forms constructed of solid wood or styrofoam or, alternatively, constructed of plastic which would be selectively inflated to form a 3-D shape. These prior art headdress display devices, whether wood, styrofoam or inflatable plastic, however, suffer from basic disadvantages. More specifically, the solid wood or styrofoam display devices are bulky and are relatively incapable of being easily shipped, in quantity, through the mails. Additionally, the prior art styrofoam or wood headdress display devices occupy an excess of space when they are being stored. Their bulk, when not in actual use is a disadvantage, from a storage and shipping point of view. On the other hand, however, the plastic inflatable headdress display devices, also in the prior art, while being capable of being sent through the mails in a flat condition and being capable of being stored in a relatively small amount of space, suffer from the disadvantage in that they require a source of air for inflating and, in addition, are rendered totally useless if they are accidentally punctured during shipment, storage or display. Additionally, they require an air valve for sealing the device which adds to the cost per display. Thus, inflatable headdress displays also suffer from disadvantages.

The present invention seeks to overcome the disadvantages of the prior art. A collapsible or knock-down headdress display device which can be shipped and stored in a flat space-conserving condition thereby not occupying an excessive amount of space, is an object which is sought to be attained by the present invention. Additionally, a headdress display device which can be assembled in a minimum amount of time without the necessity of resorting to a remote source of air and which will not be easily rendered useless by the inadvertent puncturing of the device is also an object sought to be attained by the present invention. An inexpensive, collapsible device, able to be shipped and stored in a minimum of space and assembled for use, as desired, is the basic thrust of the present invention.

SUMMARY OF THE INVENTION

The collapsible or knock-down headdress display device basically comprises a cardboard base member and a cardboard head silhouette member. The base member and the head silhouette member are connected together to provide a 3-D form over which various headdresses can be fitted for promotional display purposes. The headdress display device is able to be disassembled, shipped and stored in a flat condition and, as and when desired, can be simply and easily assembled for final point-of-display purposes.

The base member, in the preferred embodiment, made from cardboard, is constructed as a substantially rectangular flat piece which is provided with a longitudinal slit extending and opening upwardly with respect to the surface upon which the display is intended to be mounted. The flat head silhouette member, also in the preferred embodiment constructed from cardboard, has a basic outline shape of a human head. The head silhouette member is adapted to be connected to the base member to thereby provide a 3-D head-shaped piece over which a wig, full or partial facial mask, over-the-head mask or other headdress can be easily placed for display purposes. The head silhouette member, in the preferred embodiment, is provided with a longitudinal slit having a downwardly extending opening. The slit of the head silhouette member is adapted to slide into, receive, and interfit with the slit of the base member. When properly assembled, the bottom edge of the head silhouette member and the bottom edge of the base member define a flat basal plane for resting on the surface upon which the display device is sought to be mounted.

Additionally, the head silhouette member is provided with a plurality of head contour members, also in the preferred embodiment, constructed from flat cardboard. These head contour members are intended to be connected to the front of the head silhouette member to provide a more shapely 3-D form which is more realistic to the human head than the use of the silhouette member and base member alone. The head contour members are preferably semi-circular having longitudinal slits extending and opening to their flat sides, and are adapted to be received within radially extending slots located on the curved front edge of the head silhouette member. The head contour members provide additional back support for the headdresses that are displayed.

The knock-down headdress display device can be shipped and/or stored in a flat condition and, therefore, takes up a minimum amount of space until used. Therefore, the present invention is a significant improvement over the prior art styrofoam or solid wooden head display devices which are necessarily bulky.

When is is desired to provide a headdress display device, the head silhouette member is slid into the base member and the head contour members are slid into the radially extending slits of the head silhouette member to provide a realistic 3-D form over which various headdresses can be placed for display. This simple manual assembly takes place without the necessity of a remote source of air and, retains its full utility even if the device is accidentally punctured or cut during shipment, storage or assembly. Thus, the present invention is a significant improvement over the prior art inflatable plastic display devices.

BRIEF DESCRIPTION OF THE DRAWINGS

FIG. 4 is a top perspective view of the present invention in its assembled form;

FIG. 5 is a front perspective view of the present invention in its assembled form.

DETAILED DESCRIPTION OF THE PREFERRED EMBODIMENT AND THE DRAWINGS

Figure 1:
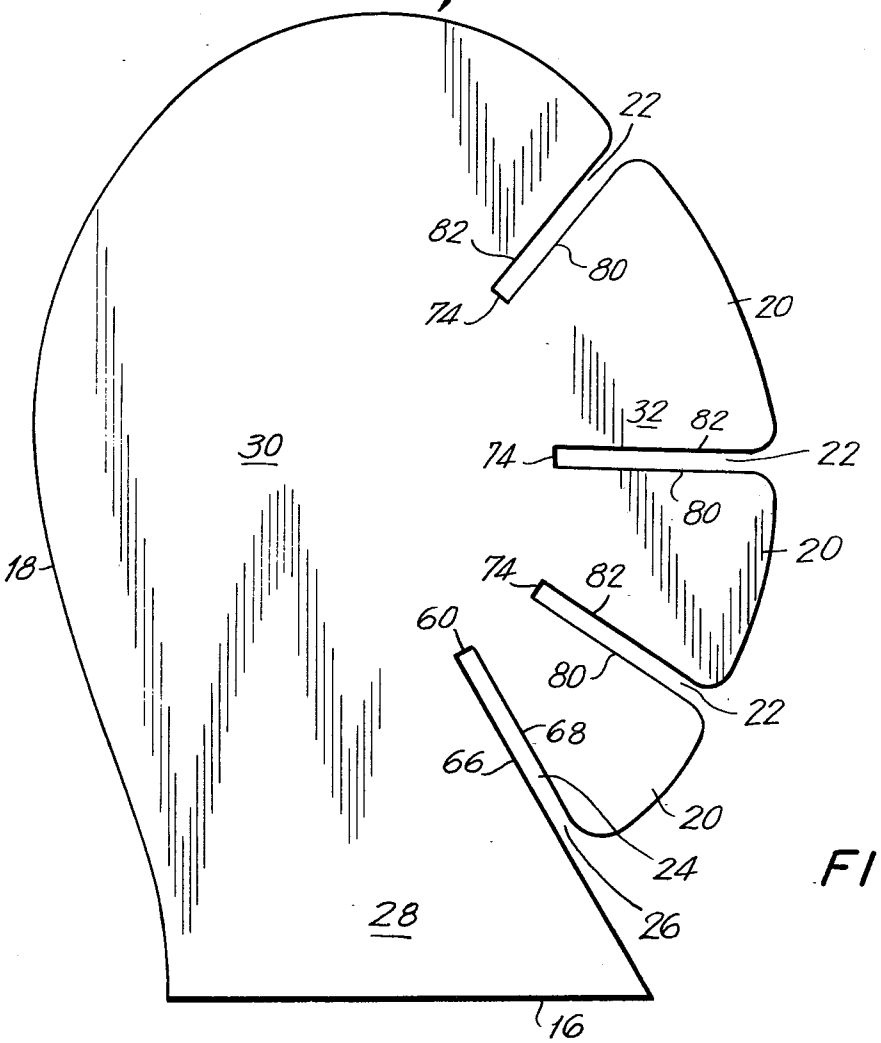
FIG. 1 is a top plan view of the head silhouette member of the present invention.

The head silhouette member 10 is clearly shown in FIG. 1. The head silhouette member 10 and, in addition, the other members of the present invention, are preferably constructed from a single layer of corrugated cardboard but can, alternatively, be constructed of any relatively sturdy material. Cardboard is, however, the preferred material since it is relatively inexpensive and lightweight, yet sturdy enough to support itself and the headdress which will be displayed by the display device. The head contour members 12, best shown in FIG. 2, and the base member 14, best shown in FIG. 3, are also preferably constructed from a single layer of corrugated cardboard. However, it should be appreciated, that the head silhouette member 10, the head contour members 12 and the base member 14 can be constructed from any relatively flat and sturdy material. Thus, for example, wood or plastic can also be used, yet cardboard is preferred since it is relatively inexpensive and lightweight.

The head silhouette member 10, cut from cardboard, has an outline basically in the form of a human head in silhouette. The head silhouette member 10 is defined by a standing edge 16 located at the bottom of the member, a curved rear edge 18 outlining the back of the head, and a plurality of front tabs 20. The front tabs 20 are defined and separated by radially extending slits 22 which project outwardly from the central portion of the head silhouette member 10. A longitudinal slit 24 is provided, extending to standing edge 16, which has a downwardly directed opening 26. The head silhouette member 10 is basically divided into three distinct yet connected sections: the neck section 28 bounded at the rear by the lower portion of rear edge 18, bounded on its bottom by standing edge 16, and bounded at its front by one edge 66 of downwardly projecting longitudinal slit 24; a head section 30, bounded by the upper portion of rear edge 18; and a face section 32, comprised of the front tabs 20.

Figure 2:
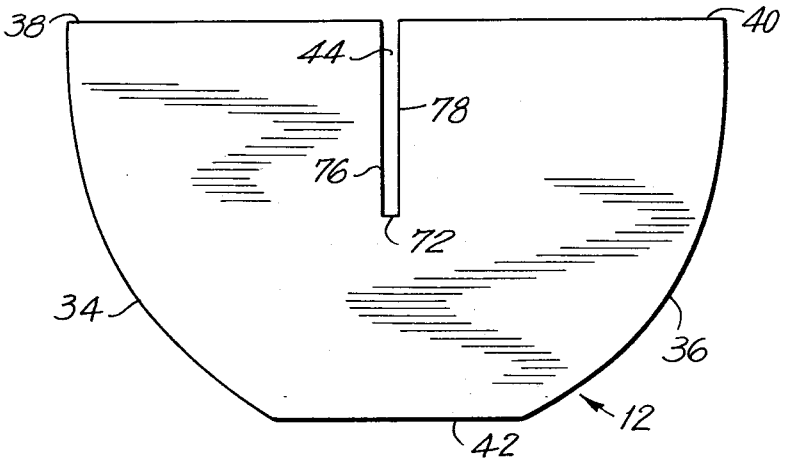
FIG. 2 is a top plan view of a head contour member of the present invention.
Figure 3:
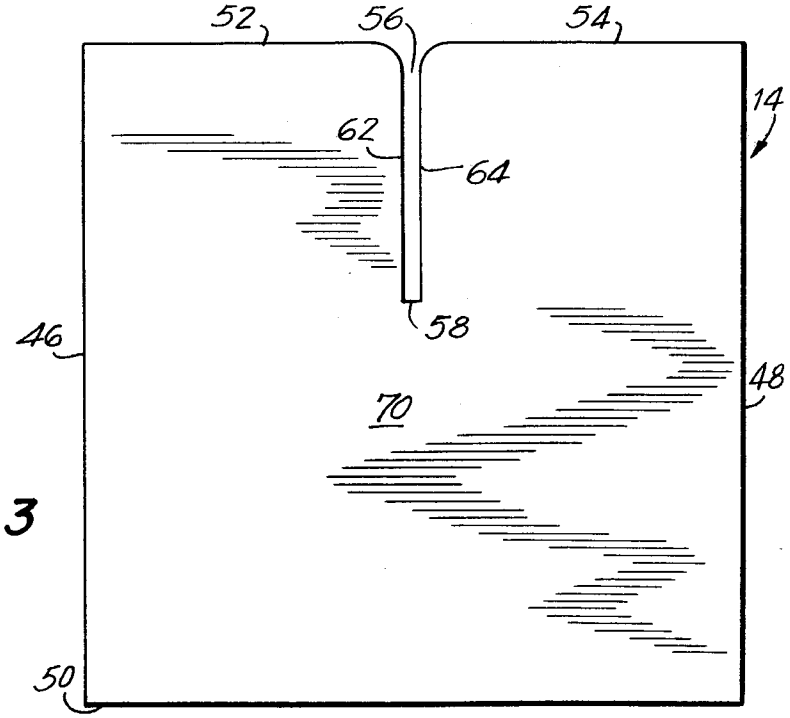
FIG. 3 is a top plan view of the base member of the present invention.

Head contour member 12, best seen in FIG. 2, has two curved edges 34 and 36 which extend between rear edges 38 and 40, respectively, and flat front edge 42. A longitudinal slit 44 having an opening which extends rearwardly is cut into the head contour member 12 and separates rear edge 38 from rear edge 40.

The base member 14, best seen in FIG. 3, is basically rectangular in shape, being defined on three sides by side edges 46 and 48 and base edge 50. Top edges 52 and 54 are separated by a longitudinal slit 56 which is spaced generally equidistant between side edge 46 and side edge 48 and extends perpendicularly to base edge 50. The longitudinal slit 56 opens upwardly.

As previously mentioned, in the preferred embodiment, the head silhouette member 10, the head contour members 12 and the base member 14 are cut from a single thickness of corrugated cardboard. The width of the longitudinal slit 24, radially extending slits 22, longitudinal slit 44 and longitudinal slit 56 are all slightly less than or approximately equal to the thickness of the head silhouette member 10, the head contour members 12 and the base member 14. Thus, the pieces of the display can be assembled such that the longitudinal slits pass over the thickness of the individual pieces and are frictionally held in position.

Figure 6:
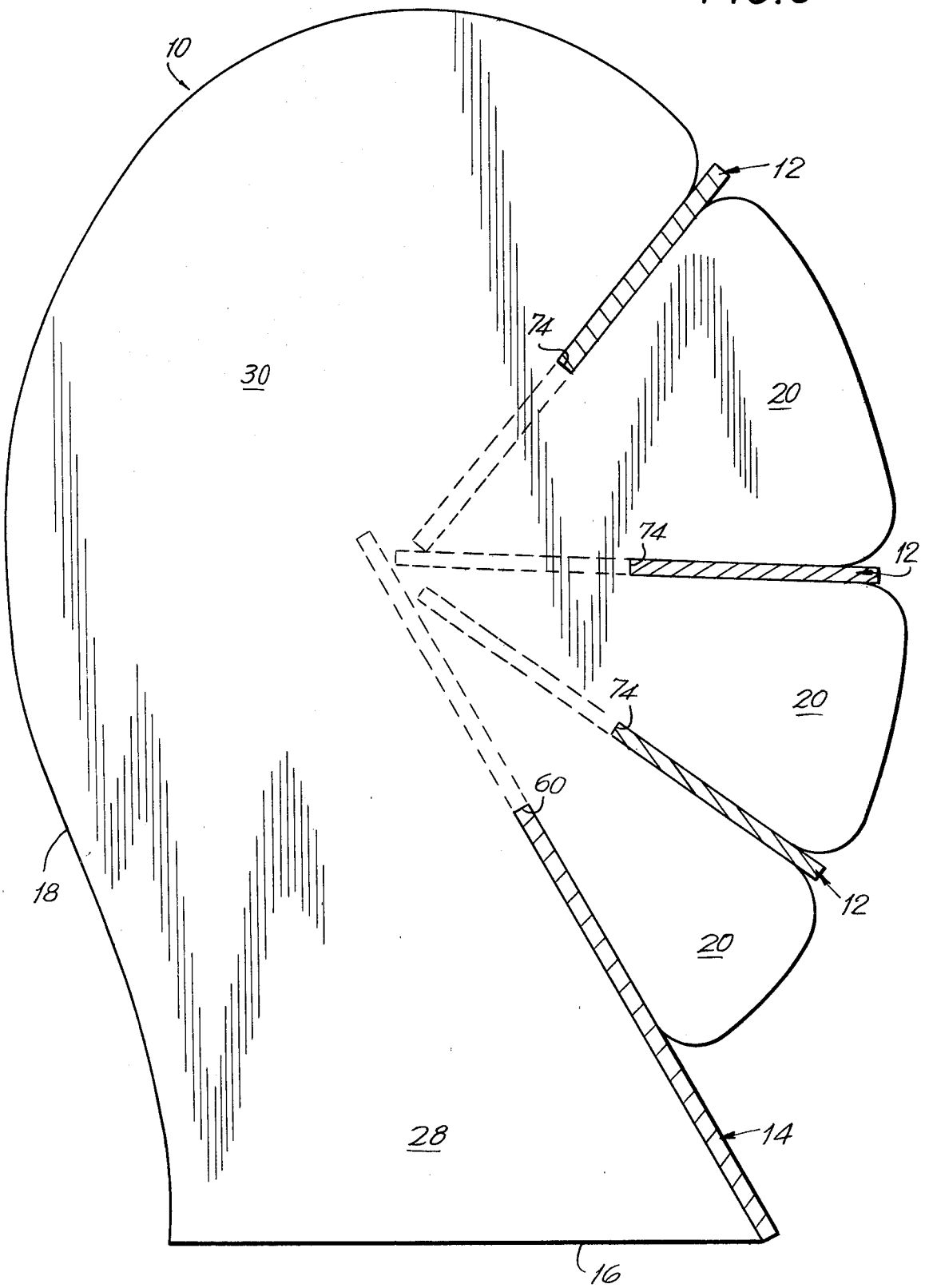
FIG. 6 is a cross sectional view taken along lines 6—6 of FIG. 4.

As best seen in FIGS. 4, 5 and 6, the headdress display is selectively assembled into a 3-D form in the shape of a human head which is then capable of displaying a headdress. When it is desired to assemble the headdress display, the base member 14 is connected to the head silhouette member 10. This is accomplished as follows: the longitudinal slit 56 of base member 14 is inserted upwardly into the longitudinal slit 24 of the head silhouette member 10. The base member 14 is then slid upwardly, the plane defined by the flat head silhouette member 10 being maintained perpendicular to the plane defined by the flat base member 14, until the end 58 of longitudinal slit 56 abuts against the end 60 of longitudinal slit 24. The sides 62 and 64 of longitudinal slit 56 will thus be in frictional contact with the flat surfaces of the head section 30. With the longitudinal slit 56 pushed upwardly until it interfits with longitudinal slit 24, a basal plane for supporting the display is thus defined by the perpendicular intersection of standing edge 16 of head silhouette member 10 with the base edge 50 of the base member 14. After the headdress display is assembled, the standing edge 16 will extend perpendicularly to the base edge 50 of the base member 14. Thus, a basal plane is defined for supporting the headdress display on a counter top or other work surface. The sides 66 and 68 of longitudinal slit 24 will frictionally engage, when the headdress display is assembled, the centrally located gripping area 70 of base member 14. A complete knock-down or collapsible headdress display is thus provided by the simple assembly and connection of the base member 14 with the head silhouette member 10.

In the preferred embodiment of the present invention, however, at least one head contour member 12 is also connected to the head silhouette member 10 to thus provide additional backing edges for the mask or other headdress sought to be displayed by the present invention. In the preferred embodiment, three head contour members 12 are connected to the head silhouette member 10. The head contour members 12 are connected to the head silhouette member 10 by interfitting, by sliding, the longitudinal slits 44 of the head contour members 12 with the radially extending slits 22 of the face section 32 of the head silhouette member 10. Each head contour member 12 is slid into one of the radially extending slits 22 until the ends 72 of longitudinal slits 44 abut against the ends 74 of radially extending slits 22. The head contour members 12 are assembled so that they extend perpendicularly to the plane defined by the flat head silhouette member 10. The sides 76 and 78 of the longitudinal slits 44 of the head contour members 12 will frictionally engage, when the headdress display is assembled, the head section 30 of the silhouette member 10. The sides 80 and 82 of radially extending slits 22 will frictionally engage the gripping areas 84 of the head contour members 12.

In alternate embodiments of the invention, the head contour members 12 and the base member 14 can be constructed without the interfitting longitudinal slits 44 and 56, respectively. If the members are so constructed, then the head contour members 12 and the base member 14 will still be received by the longitudinal slit 24 and radially extending slits 22 of head silhouette member 10. A sturdier configuration results in the use of interfitting longitudinal slits both on the head silhouette member 10, the head contour members 12 and the base member 14.

When the headdress display is assembled without the head contour members 12 connected thereto, a three dimensional head-shaped form results which is ideally suited for displaying various headdresses. The headdress display can be shipped and stored in a flat condition and, when desired, can be quickly and simply assembled for use at point-of-sale display locations. The assembly of the headdress display with the head contour members 12 results in an even more complete three dimensional head-shaped form. The head contour members 12 provide back support surface edges for facial masks secured to the display.

It should be understood that the above-described embodiment of the invention is meant to be merely illustrative of the invention. Accordingly, reference should be made to the following apended claims and equivalents thereof in determining the scope of the invention.

I claim:

1. A knock-down headdress display comprising:

(a) a head silhouette member;

(b) said head silhouette member having a lower supporting edge;

(c) said head silhouette member having an upwardly and angularly extending slit;

(d) the lower end of said slit terminating at one end of said lower supporting edge of said head silhouette member;

(e) a base member having a supporting edge;

(f) said base member having an outline configuration substantially different from the outline configuration of said head silhouette member and defining an area of smaller cross section than the head silhouette member;

(g) said base member having a slit cut therein which selectively interfits with said slit of said head silhouette member;

(h) said base member and said head silhouette member, when connected together, being at right angles to one another; and (i) said base member, when connected to said head silhouette member, being angularly disposed with respect to said lower supporting edge of said head silhouette member.

2. A headdress display as claimed in claim 1, further comprising:

(a) said head silhouette member having at least one radial extending slit;

(b) head contour members are provided, corresponding in number to the number of radial extending slits, each of said head contour members having an outwardly projecting convex surface; and (c) said head contour members are selectively interfitted into said radial extending slits.

* * * * *